US006227378B1

(12) United States Patent
Jones et al.

(10) Patent No.: US 6,227,378 B1
(45) Date of Patent: May 8, 2001

(54) SORTING SYSTEM FOR GROUPS OF ITEMS HAVING RECIRCULATION

(75) Inventors: Keith Malcolm Jones, Chippenham; Gregory Charles Hopkins, Swindon, both of (GB)

(73) Assignee: the Post Office, Croydon (GB)

( * ) Notice: Subject to any disclaimer, the term of this patent is extended or adjusted under 35 U.S.C. 154(b) by 0 days.

(21) Appl. No.: 09/275,432

(22) Filed: Mar. 24, 1999

(30) Foreign Application Priority Data

Mar. 27, 1998 (GB) ..... 9806668

(51) Int. Cl.[7] ..... B07C 9/00

(52) U.S. Cl. ..... 209/698; 209/584; 209/900; 209/919; 198/703

(58) Field of Search ..... 209/584, 900, 209/911, 919, 698; 198/469.1, 703

(56) References Cited

U.S. PATENT DOCUMENTS 2,617,527 * 11/1952 Smith ..... 209/919 X
3,980,553 * 9/1976 Quinn ..... 209/919 X
4,244,672 1/1981 Lund .
5,994,657 * 11/1999 Maier et al. ..... 209/584

FOREIGN PATENT DOCUMENTS 0 476 984 A2 3/1992 (EP) .
1 506 516 4/1978 (GB) .

* cited by examiner

*Primary Examiner*—Tuan N. Nguyen
(74) *Attorney, Agent, or Firm*—Larson & Taylor PLC

(57) ABSTRACT

A sorting system is disclosed, for example for mail items. In the disclosed system, a circulating storage system can receive items from an inlet, and deposit them in an appropriate output receptacle which has been allocated to items in a particular group. For example, the items can be sorted by destination, and each output receptacle can be allocated to a particular destination. In the event that the destination of an item has not output receptacle allocated thereto, the system controller can determine whether to allocate a receptacle, or whether to recirculate the item within the circulating storage system. This possibility allows items to be grouped together within the system, until there are sufficient items for a particular destination to allow them to be handled efficiently, and in particular allows the allocation of output receptacles to destinations to be controlled efficiently.

13 Claims, 1 Drawing Sheet

SORTING SYSTEM FOR GROUPS OF ITEMS HAVING RECIRCULATION

FIELD OF THE INVENTION

This invention relates to a sorting system, in particular, though not necessarily, for use in sorting mail items.

BACKGROUND OF THE INVENTION

In a mail sorting system, there is a need to sort a large number of individual items into groups of such items which can be processed together. For example, mail items can be sorted into groups, with each group being intended for a particular geographical destination. For example, when handling newly received items, the sorting system may be required to sort the items on the basis of their intended final, or "outward" destinations, which may for example be relatively large geographical areas. Additionally, the items may be sorted by product group, for example the class of service required. When the system is processing mail which has been received from another sorting station, then those items may be intended for delivery within a relatively small geographical area, and the sorting system then sorts them into groups of items intended for delivery to even smaller areas, for example areas which might be covered in a single round of deliveries.

In either case, a conventional sorting system might include a number of output receptacles for receiving sorted items, with one receptacle being designated for items intended for each of the relevant geographical areas. When the number of destinations is large, this means either that the sorting system itself must be very large, including a large number of output receptacles, or that the sorting must be carried out in two or more stages, with one sorting stage being used for a relatively coarse sort, and second and any subsequent stages being used for finer sorts.

British Patent No. 1,506,516 describes a circulating apparatus including a plurality of receptacles for receiving sorted items. Received items are sorted manually and place in the appropriate receptacles, which can be emptied and replace as desired.

BRIEF SUMMARY OF THE INVENTION

According to an aspect of the present invention, there is provided a sorting system, comprising:

an inlet area, for receiving items;

an outlet device, comprising a plurality of outlet receptacles, the output receptacles being detachable to allow the removal of items therefrom;

a plurality of storage receptacles, mounted for circulation past the inlet area and the outlet device; and a control system;

wherein an incoming item is passed from the inlet area to a storage receptacle;

wherein the control system receives data identifying each item within the system;

wherein output receptacles are assigned to groups of items having particular common characteristics; and wherein the control system:

determines when output receptacles should be detached to allow the removal of items therefrom;

determines the assignment of output receptacles to groups of items;

and, when a storage receptacle, containing an item belonging to a group having no output receptacle assigned thereto, approaches the outlet device, determines whether to assign an output receptacle to said group or whether to recirculate said item within said storage receptacle.

This allows a group of mail items to be stored temporarily within the system, until the number of such items is such that those items can be grouped together efficiently for further processing. An advantage is that the number of physical outlets may be relatively small, and may be far less than the number of potential destinations for the sorted items.

According to a preferred embodiment of the invention, there is provided means for identifying an intended future destination of a group of items supplied to an output.

This allows the output group of items to be forwarded efficiently to the next stage in the process.

This identification may be in the form of a signal sent to a display (for example, a LED display), which can be read by a human operator to determine the intended future destination of the sorted group. Alternatively, the identification may be in the form of a code applied to the output receptacle, which may be read by an automated handling system. Alternatively, the identification may be in the form of a signal, sent to an automated handling system, which directs that automated handling system as regards the intended future destination of the sorted group.

Preferably, the system is for sorting mail items.

BRIEF DESCRIPTION OF THE DRAWINGS

For a better understanding of the present invention, and to show how it may be brought into effect, reference will now be made, by way of example, to the accompanying drawing, in which.

DETAILED DESCRIPTION OF THE INVENTION

Figure 1:
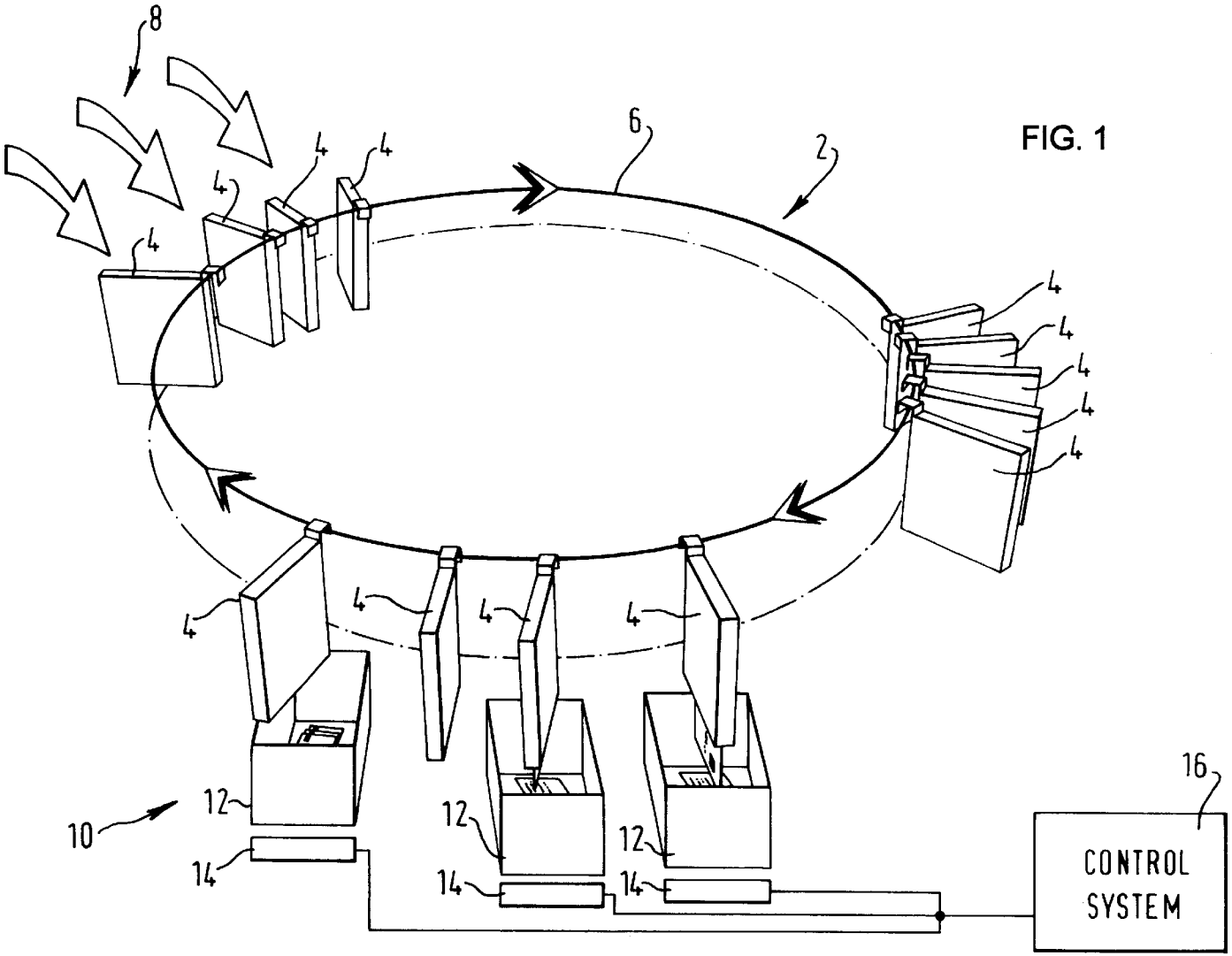
FIG. 1 is a partial schematic representation of a sorting system in accordance with the invention.

FIG. 1 shows a carousel-type system 2, having a large number of storage receptacles 4, carried around a track 6, in the direction shown by the arrows marked thereon. The carousel system is of a type which is generally known in itself, although it must have certain characteristics for optimum use in the overall sorting system of the present invention. These characteristics will be discussed in more detail below.

In this illustrative example, the storage receptacles 4 are of a type generally intended for transporting large (for example A4 size), relatively flat mail pieces, each mail piece being held within the storage receptacle in a vertical plane. In most cases, each storage receptacle will carry only one mail piece at a time, although there are circumstances discussed below in which more than one mail piece may be carried in a storage receptacle. As a maximum, the storage receptacle may for example be able to carry, say, five such mail pieces at a time, although this is unlikely to be required in practice.

In a generally conventional way, mail pieces are supplied to the carousel 2 at an inlet area 8, through mail inlet feeds, which are generally conventional, and hence are not described further. In this illustrative example, there are several inlets, although a system with only one inlet could be envisaged.

The system also has an output area 10, in which mail pieces are transferred to output receptacles 12. In this illustrative example, the output receptacles take the form of deep trays, which may typically be able to hold around 40 of the type of items carried by the storage receptacles. Normally, each output receptacle 12 is positioned to receive items from the storage receptacles 4 as they pass above. However, these output receptacles are removable from their normal locations, to allow the collected mail pieces to be removed therefrom.

For example, the outlet receptacle 12 may be manually detachable by a human operator, who will need to be provided with an indication as to the next destination for the contents. As illustrated, an electronic (for example, LED) display 14, associated with each output receptacle 12, indicates the future destination in a way which allows the operator to pass the contents of the receptacle on in an appropriate way.

As an alternative, the outlet receptacles may be automatically detachable, and passed to a further automated handling system. If this automated handling system has means for reading codes which identify the intended future destination of the contents, then each storage receptacle may have an appropriate code applied thereto before detachment of the receptacle. For example, if the handling system is provided with a bar code reader, then a suitable bar code can be applied to the receptacle. Alternatively, if the handling system has a magnetic tag reader, then a magnetic tag applied to the receptacle may be suitably coded.

As a further alternative, if the control of the sorting system and the downstream automated handling system is unified, the automated handling system may be provided directly with instructions regarding the destination of the receptacle and its contents.

Each of the output receptacles is associated at any time with a mail group, that is a group of mail pieces with similar processing characteristics. For example, a mail group may be a group of items intended for a single destination. Thus, when a storage receptacle, containing an item belonging to such a group, passes above the appropriate output receptacle, the item can be released into the output receptacle.

The present invention is concerned mainly with the way in which the mail groups are defined, and the way in which it is determined when to remove items from output receptacles.

These aspects of the system are determined by a control system 16. The control system receives input information from, and transmits control signals to the rest of the system. The information may be transmitted over wires, or wirelessly, for example over IR links. The control system 16 receives information about each mail piece as it is about to enter the system through the inlet area 8. Specifically, the control system receives information about individual mail piece characteristics, which include all information required by the system to identify the mail group for which the item is destined. This information is stored in such a way that, at any time, the system knows the characteristics of each mail piece in each storage receptacle, and also preferably knows the characteristics of all of the mail pieces approaching the inlets. However, the information may be supplied to the control system before the mail piece reaches the carousel, as it reaches the carousel, or after it reaches the carousel.

The control system also receives information about the operating environment of the system, and the system requirements.

Based on this information, the control system can dynamically allocate output receptacles to mail groups, and can control the times at which items are removed from output receptacles.

The system shown in FIG. 1 includes a single carousel, for ease of illustration. However, there may be advantages in using a system with two or more carousels. In a system with two carousels, for example, at least a part of a first, inlet carousel is located physically above at least a part of a second, outlet carousel, and mail pieces can be transferred from the first carousel to the second as desired.

For the purposes of illustration only, it is mentioned that a system in accordance with the invention may have of the order of 1000 storage receptacles, and 200–300 output receptacles. This is a relatively high proportion of storage receptacles to output receptacles, reflecting the fact that, in accordance with the invention, it may be decided to recirculate some items rather than send them to outputs.

In use of the system shown in FIG. 1, received mail items arrive at the inlet feeds. Each time at one of these feeds is generally directed into the next free storage receptacle. Each mail item has already been processed at an earlier stage in the overall sorting system, and has been allocated to a future destination, which generally defines the mail group to which it should be sorted. Then, when an item is placed into an appropriate storage receptacle, the control system notes the receptacle into which that item has been placed.

The carousel 6 is continuously rotating, which means that empty storage receptacle 4 are regularly passing the inlets.

It should also be noted that, in accordance with the invention, some mail pieces are recirculated past the mail inlets. In the event that, as a mail piece destined for a particular mail group waits at an inlet, an occupied storage receptacle containing an item for that mail group passes the inlet, the mail piece can be put into the same storage receptacle.

The essence of the system in accordance with the invention is that the system can serve more mail groups than there are output receptacles. Thus not all mail groups have an output receptacle assigned thereto as any given time. This can be achieved because the control system can take the decision that items may be stored in their respective storage receptacles 4 within the carousel, until such time as there are sufficient items, having a common intended future destination, to allow such items to be grouped together efficiently for movement to that future destination.

Once the control system has determined that there are sufficient items within the carousel, all intended for the same onward destination, the system can be controlled to feed those items to an outlet receptacle, as their respective storage receptacles pass the relevant output receptacle. The individual storage receptacles on the conveyor move continuously, and carry the items past the outlets. Under the control of the control system, the contents of each receptacle, identified as containing an item which is intended for onward transmission at this point, are emptied into the detachable outlet receptacle.

The operation of the control system will now be described in more detail.

The inputs to the control system can be broken down into three areas: individual mail piece characteristics; the operating environment and system performance parameters.

The individual mail piece characteristics include all information required by the sorting system to identify the mail group for which the mail piece is destined.

The operating environment includes the input mail set characteristics, which includes statistical information about the composition of the incoming mail pieces; the current time, which may be a factor in determining sorting priorities;

definitions of mail groups required for the next processing stage; despatch requirements for each mail group such as time of despatch and destination, because, if mail is about to be despatched to a particular destination, the highest priority may be to sort mail intended for that destination; and the performance criteria in order to achieve business requirements. It should be noted that this set of input data are variable from one process to the next, between processing centres and from one time to another. Information from the previous mail processing operation can be used to provide accurate and detailed knowledge to assist in the development of the appropriate strategy for managing the system.

System performance parameters include the current mail processing rate; the position of each individual mail piece within the carousel; the current assignment of mail groups to outlet receptacles; and the location of mail pieces belonging to particular mail groups around the carousel.

Based on this information, the control system has a range of options available to maximise the efficiency of the sorting operation. For example, if a particular mail piece in the carousel, approaching the output receptacles, belongs to a mail group which does not presently have an output receptacle assigned thereto, the control system can make a decision either to recirculate the mail piece, that is to store the mail piece in the storage receptacles, or to allocate the required mail group to one of the output receptacles.

Further, the system can redefine mail groups, that is combine two previously defined mail groups into one mail group, or split one previously defined mail group into several new mail groups. If necessary, the control system can cause re-circulation of mail groups external to the system. For example, combining mail groups may be helpful at a time when the system is under pressure, and a redefined mail group, made up of two previously defined mail groups, can be recirculated into the sorting system for resorting at a time when the system is under less pressure.

The control system makes use of one or more of the inputs to generate internal parameters and data that are used to support its decision making process. Such parameters and data may be used to modify or update the definition of the input mail set to improve the decision making process.

An example of the operation of the control system will now be given:

Starting from a system with no mail in it, as mail pieces enter the system, the most frequently occurring mail groups identified within the input mail set are allocated to respective output receptacles. Mail pieces in mail groups with allocated output receptacles are then transferred from the storage receptacles to the output receptacles as they pass. Once all of the output receptacles have mail groups allocated to them, mail destined for other mail groups can be stored within the storage receptacles. Then, as output receptacles fill up and are emptied, mail groups which have mail pieces stored within the storage receptacles can be allocated to the emptied output receptacle, allowing those storage receptacles to be emptied. While the number of different mail groups within the storage receptacles is relatively low, the amount of recirculation is kept low and hence the rate of mail processing is kept high. The amount of recirculation affect the overall processing rate because each recirculating item fills a storage receptacle which is unable to receive an incoming mail piece.

However, if the mail profile changes, for example because the arriving mail pieces belong to an increased number of different mail groups, the number of occupied storage receptacles, and the amount of mail being recirculated within the storage receptacle area, may increase, with a subsequent fall in the mail processing rate.

The control system is then able to take action to maintain an acceptable mail processing rate. Specifically, it may be necessary to remove from the storage receptacle area some of the mail pieces belonging to mail groups being held therein.

As mentioned above, in the illustrated embodiment, the output receptacles take the form of deep trays, which may typically be able to hold around 40 items. All other things being equal, therefore, it is desirable to empty an output receptacle, and transfer the mail group of items, having a particular onward destination, when the number of such items has reached or closely approaches the capacity of the outlet receptacle.

However, there are other factors which are also considered, and the control system has the ability to select the most appropriate output receptacles to empty/clear away, based on not only the amount of fill in each output receptacle, but also: the destination of the mail group assigned to an output receptacle, as it may be advantageous to empty an output receptacle if mail items are about to be despatched to the destination of the mail group assigned thereto; the number of mail groups within the storage area, which may affect the number of output receptacles which will desirably be emptied; and commercial consideration, because it may be relatively cheap to store some items for a short while but, if particular mail groups are automatically despatched as soon as they are emptied from output receptacles, it will be inefficient to empty such receptacles when they are anything less than full.

The control system could for example choose those mail groups with destinations within the current mail processing geographic area to eject from the output receptacle area first. This has minimum impact on distribution between geographic areas. However, if the relevant output receptacles are not full then the amount of wasted space in holding areas is increased.

A further option is to empty a small number of output receptacles, and redefine some of the mail groups on-line to implement a coarser sort. This redefinition used knowledge about the mail pieces held within the storage receptacle area of the system in order to get the best sort resolution possible with the removal of the required amount of mail from the storage receptacle area. Once mail has been removed from the storage receptacle area and the mail processing rate increased, then, if the input mail set characteristics allow it, the original mail groups may be used. The mail ejected with the coarser sort can either be manually recycled to the system inputs for later processing to achieve the appropriate sort resolution in the next pass, or it can be despatched to the next process in its current state. This decision is based on spare processing capacity at the current stage and the impact on the next process.

Alternatively, if it is not possible to remove enough mail from the storage receptacle area by the redefinition of mail groups, mail has to be ejected from the system and re-fed later in the processing cycle by re-circulation outside of the sorting system itself.

It is this ability of the control system to redefine the processing of mail combined with the amount of on-line storage within the carousel that optimises the efficient usage of the physical sorting channels available from the system and allows the possibility of sorting to a greater number of mail groups than the number of physical output receptacles.

What is claimed is:

1. A sorting system for mail items, comprising:

an inlet area, for receiving mail items;

an outlet device, comprising a plurality of outlet receptacles for sorted mail items; and a plurality of storage receptacles, mounted for circulation past the inlet area and the outlet device, such that received mail items are passed from the inlet area to a storage receptacle, and from the storage receptacle to an outlet receptacle, output receptacles being assigned to groups of mail items having particular common characteristics; and wherein, when a storage receptacle contains a mail item belonging to a group having no output receptacle assigned thereto, said mail item is recirculated within said storage receptacle, such that the number of said groups can exceed the number of output receptacles.

2. A sorting system, comprising:

an inlet area, for receiving items to be sorted;

an outlet device, comprising a plurality of outlet receptacles, the output receptacles being detachable to allow the removal of items therefrom;

a plurality of storage receptacles, mounted for circulation past the inlet area and the outlet device; and a control system;

wherein an incoming item is passed from the inlet area to a storage receptacle;

wherein the control system receives data identifying each item within the system;

wherein output receptacles are assigned to groups of items having particular common characteristics; and wherein the control system:

determines when output receptacles should be detached to allow the removal of items therefrom;

determines the assignment of output receptacles to groups of items; and when a storage receptacle containing an item belonging to a group having no output receptacle assigned thereto, approaches the outlet device, determines whether to assign an output receptacle to said group or whether to recirculate said item within said storage receptacle, such that the number of said groups can exceed the number of output receptacles.

3. A sorting system as claimed in claim 2, wherein the control system makes its determinations on the basis of information relating to each item within the system.

4. A sorting system as claimed in claim 2, wherein the control system makes its determinations on the basis of information relating to the current time.

5. A sorting system as claimed in claim 2, wherein the control system makes its determinations on the basis of information relating to despatch requirements for groups of items.

6. A sorting system as claimed in claim 2, wherein the control system makes its determinations on the basis of information relating to the position of each item within the carousel.

7. A sorting system as claimed in claim 2, wherein the control system makes its determinations on the basis of information relating to the location of items belonging to particular groups around the carousel.

8. A sorting system as claimed in claim 2, comprising means for identifying an intended future destination of a group of items supplied to an output receptacle.

9. A sorting system as claimed in claim 8, wherein the identification is in the form of a signal sent to a display which can be read by a human operator.

10. A sorting system as claimed in claim 8, wherein the identification is in the form of a code applied to the output receptacle, which may be read by an automated handling system.

11. A sorting system as claimed in claim 8, wherein the identification is in the form of a signal, sent to an automated handling system, which directs that automated handling system as regards the intended future destination of the sorted group.

12. A sorting system as claimed in claim 2, for sorting mail items, the storage receptacles being suitable for containing less than five generally flat A4 items held in a vertical plane.

13. A sorting system as claimed in claim 12, the output receptacles being suitable for holding between twenty and eighty such mail items.

* * * * *